US009281643B1

(12) United States Patent
Tseng

(10) Patent No.: US 9,281,643 B1
(45) Date of Patent: Mar. 8, 2016

(54) CONNECTOR HAVING METAL SEPARATING PLATE BEING FASTENED BY TONGUE PLATE IN INTEGRAL FORMATION

(71) Applicant: SIMULA TECHNOLOGY INC., Taoyuan Dist., Taoyuan (TW)

(72) Inventor: Te-Chih Tseng, Taoyuan (TW)

(73) Assignee: SIMULA TECHNOLOGY INC., Taoyuan (TW)

( * ) Notice: Subject to any disclaimer, the term of this patent is extended or adjusted under 35 U.S.C. 154(b) by 0 days.

(21) Appl. No.: 14/624,922

(22) Filed: Feb. 18, 2015

(30) Foreign Application Priority Data

Dec. 2, 2014 (TW) ..... 103221315 U

(51) Int. Cl.
*H01R 13/648* (2006.01)
*H01R 24/78* (2011.01)
*H01R 107/00* (2006.01)

(52) U.S. Cl.
CPC ..... *H01R 24/78* (2013.01); *H01R 2107/00* (2013.01)

(58) Field of Classification Search
CPC ..... H01R 32/688
USPC ..... 439/607.08–607.11, 607.35, 607.4
See application file for complete search history.

(56) References Cited

U.S. PATENT DOCUMENTS 5,073,130 A * 12/1991 Nakamura ..... H01R 13/65802 439/607.32
5,304,069 A * 4/1994 Brunker ..... H01R 23/688 439/108
5,474,472 A * 12/1995 Niwa ..... H01R 23/688 439/108
6,338,635 B1 * 1/2002 Lee ..... H01R 23/688 439/108
6,997,733 B2 * 2/2006 Peng ..... H01R 13/6582 439/353
7,462,071 B1 * 12/2008 Wu ..... H01R 9/032 439/497
7,758,379 B2 * 7/2010 Chen ..... H01R 13/6485 439/607.11
7,914,328 B2 * 3/2011 Tanaka ..... H01R 13/65802 439/607.08

(Continued)

*Primary Examiner* — Neil Abrams
(74) *Attorney, Agent, or Firm* — Bacon & Thomas, PLLC

(57) ABSTRACT

The present invention is to provide a connector having a metal separating plate being fastened by a tongue plate in integral formation, which is compatible to USB Type-C standard and includes a tongue plate made of plastic integrally and provided with a metal separating plate fixedly disposed therein; a plurality of first connection terminals respectively inserted into first connection slots formed in the tongue plate near a top surface of the metal separating plate; a plurality of second connection terminals respectively inserted into second connection slots formed in the tongue plate near a bottom surface of the metal separating plate; grounding boards having structures respectively matched with the tongue plate, so as to enclose an outer edge of the tongue plate; and a metal casing having a structure matching with the tongue plate, so as to allow the tongue plate and grounding boards to be assembled into the metal casing.

12 Claims, 5 Drawing Sheets

(56) References Cited

U.S. PATENT DOCUMENTS 7,918,688 B2 * 4/2011 Lin ..... H01R 12/58 439/607.01
8,215,997 B2 * 7/2012 Hsia ..... H01R 13/6581 439/660
8,251,746 B2 * 8/2012 Zhang ..... H01R 13/6581 439/607.11
8,262,411 B2 * 9/2012 Kondo ..... H01R 13/6658 439/607.01
8,475,216 B2 * 7/2013 Tung ..... H01R 13/506 439/607.4
8,480,413 B2 * 7/2013 Minich ..... H01R 12/724 439/607.05
8,535,069 B2 * 9/2013 Zhang ..... H01R 13/6471 439/108
8,684,769 B2 * 4/2014 Kao ..... H01R 13/6471 439/607.28
8,764,488 B2 * 7/2014 Zeng ..... H01R 13/6585 439/108
8,808,029 B2 * 8/2014 Castillo ..... H01R 13/6585 439/607.05
8,851,927 B2 * 10/2014 Hsu ..... H01R 13/6594 439/607.11
8,956,187 B2 * 2/2015 He ..... H01R 13/504 439/607.35
8,961,235 B2 * 2/2015 Little ..... H01R 13/64 439/374
8,968,031 B2 * 3/2015 Simmel ..... H01R 13/659 439/108
9,106,024 B2 * 8/2015 Zhao ..... H01R 13/6594
2012/0071032 A1 * 3/2012 Tsai ..... H01R 12/724 439/660
2014/0099835 A1 * 4/2014 Chang ..... H01R 13/6581 439/682
2015/0244111 A1 * 8/2015 Ju ..... H01R 3/6585 439/607.05

* cited by examiner

CONNECTOR HAVING METAL SEPARATING PLATE BEING FASTENED BY TONGUE PLATE IN INTEGRAL FORMATION

FIELD OF THE INVENTION

The present disclosure generally relates to a connector, more particularly to a connector in which a metal separating plate is fastened by a tongue plate which is in integral formation.

BACKGROUND OF THE INVENTION

Recently, as information technology and electronic industry are vigorously developed, high quality and inexpensive and slim type various electronic devices (such as tablet computer, smart phone, driving video recorder, etc.) have become a necessary and important tool for people in life and work. Most persons are accustomed to use computers to process information in daily life and work, so the persons' demands for computer applications become more and more gradually. Therefore, in order to enable the people to transfer data (such as document files, multimedia files, picture files, etc.) between different electronic devices, the manufacturer usually disposes various types of connectors on the various electronic devices, to enable the a plurality of electronic devices to exchange data with each other via connection wires corresponding to the connectors. In numerous transmission standards of connector, the Universal Serial Bus (abbreviated as "USB") standard is the most popular. The connector compatible to the USB standard can transmit message data and provide a 5 V of actively voltage and a 0.5 A of current, so the electronic device connected with the USB connector need not be connected with an external power source and can just use the electric power from the connector compatible to the USB standard for well operation. That is reason that the USB connector has become one of main standards for connection between various electronic devices after the USB 1.0 standard is published at 1996.

Currently, the USB standard is upgraded to USB 3.1 standard. In the USB 3.1 the transmission amounts of voltage and current are increased, and the transmission speed is also improved to 10 GB per second because of improving coding loss. In addition, compared with traditional USB1.0 through USB 3.0 standard, the USB Type-C connector compatible to the USB 3.1 standard has significant variation in structure, i.e. "the structure with longitudinal symmetry", so the user can arbitrarily insert the USB Type-C plug into the USB Type-C socket corresponding thereto without particularly identifying the front or the back of the USB Type-C plug, and the usage of the USB Type-C plug can be more intuitive. However, in order to achieve the function that the USB Type-C connector can be plugged via the front or the back thereof, the USB Type-C connector must be provided with two groups of connection terminals the same therein. In addition, in order to prevent the a problem that signals of two groups of the connection terminals interfere with each other during data transmission, the manufacturer must place a metal separating plate between the two groups of the connection terminals to isolate the signal interference and noise interference from the connection terminals. Therefore, in a trend of slim type design of the electronic device being a mainstream in current industry, such USB Type-C connector may bring new difficulty and challenge for production and assembly process.

Traditionally, the manufacturer fastens the connection terminal in a tongue plate by a manner of injection molding or insertion assembly; however, if the manufacturing process of injection molding is used to fasten the metal separating plate and two groups of the connection terminals in the tongue plate, the requirement for quality of the injection molding is very high and the manufacturing cost is improved correspondingly. In the other hand, if the manner of insertion assembly is used to assemble the metal separating plate and the connection terminal, because the connector has a very tiny and precise structure and not easy to be inserted, it is not easy for the manufacturer to precisely control the production process Therefore, when the manufacturer uses one of the above-mentioned manners to produce the USB Type-C connectors, the manufacturing cost is efficiently increased and the yield rate of the products is seriously reduced.

Therefore, how to design a new assembly structure based on the special structure requirement of the USB Type-C connector to enable the manufacturer to quickly produce and assemble the USB Type-C connector with improvement of production yield rate and manufacturing cost both, is an important subject to be solved.

SUMMARY OF THE INVENTION

In order to solve the problems that the USB Type-C connector cannot improve manufacturing cost and production yield rate both due to the USB Type-C connector equipped with more metal elements (i.e. connection terminal, separating plate, etc.), the inventor designs a connector in which a metal separating plate is fastened by a tongue plate being in integral formation, based on long-term practice experience and repeated research and tests.

An objective of the present disclosure is to provide a connector in which a metal separating plate is fastened by a tongue plate being in integral formation. The connector is compatible to USB Type-C standard. The connector includes a tongue plate, a plurality of first connection terminals, a plurality of second connection terminals, two grounding boards and a metal casing. The tongue plate is made of plastic integrally and provided with a metal separating plate fixedly disposed therein. The tongue plate is provided with a plurality of first insertion holes and a plurality of second insertion holes respectively formed near a top surface and a bottom surface of the metal separating plate, and provided with a plurality of first connection slots and a plurality of second connection slots concavely disposed on a top surface and a bottom surface thereof near an end thereof. The plurality of first connection slots are respectively communicated with ends of the plurality of first insertion holes corresponding thereto. Other ends of the plurality of first insertion holes are exposed out of an other end of the tongue plate, the plurality of second connection slots are respectively communicated with ends of the second insertion holes corresponding thereto, other ends of the plurality of second insertion holes are exposed out of the other end of the tongue plate, and the tongue plate is provided with a first assembly slot and a second assembly slot concavely disposed at the top surface and the bottom surface thereof near the other end thereof. The first connection terminals are inserted into the other end of the tongue plate and respectively positioned inside the first insertion holes, to enable portions of the plurality of first connection terminals near the ends thereof to be exposed out of the top surface of the tongue plate via the plurality of first connection slots. The second connection terminals are inserted into the other end of the tongue plate and respectively positioned inside the second insertion holes, whereby portions of the second connection terminals near the ends thereof can be exposed out of the bottom surface of the tongue plate via the second connection slots. Structures of the grounding boards are respectively matched with that of assembly slots, so the grounding boards can be positioned in the assembly slots and enclose an outer edge of the tongue plate near other end of the tongue plate. The metal casing has a structure matching with the tongue plate, so the tongue plate and the grounding boards can be assembled into the metal casing.

In traditional manufacturing method, the metal separating plate and the connection terminals are fastened together or inserted into the tongue plate respectively, it causes the problems of too high manufacturing cost and low production yield rate. On the contrary, in the present disclosure the metal separating plate is fixedly disposed in the tongue plate by integral formation, and the first and second connection terminals are then respectively inserted into an upper portion and lower portion of the tongue plate relative to the metal separating plate, so that the problems caused in traditional manufacturing method can be prevented efficiently, and assembly difficulty can be efficiently reduced and production yield rate of the connector can be improved efficiently, and the production efficiency can be further improved.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
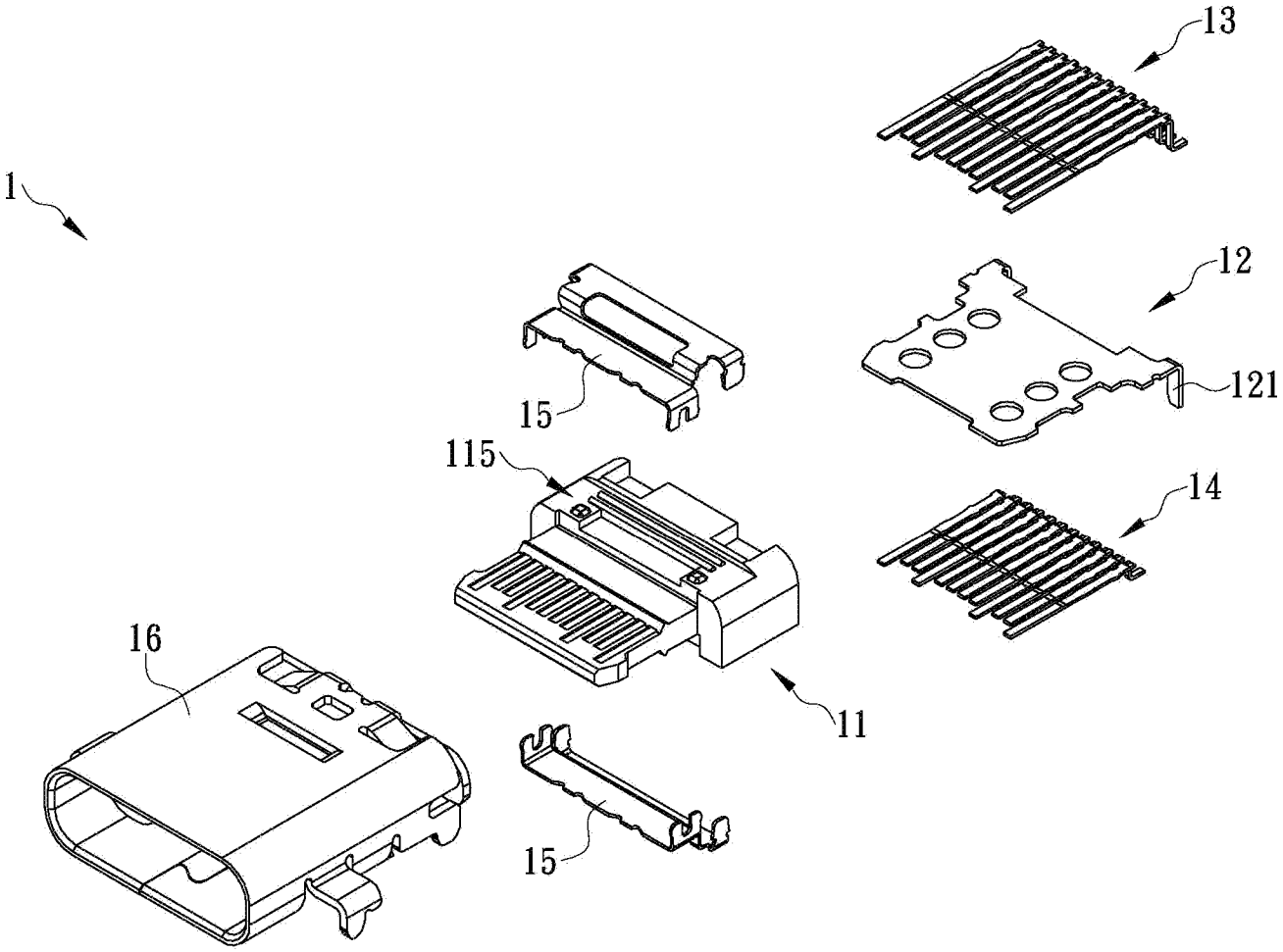
FIG. 1 is an exploded perspective view of a connector of a preferred embodiment of the present disclosure.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

The present disclosure illustrates a connector in which a metal separating plate is fastened by a tongue plate which is in integral formation. Please refer to FIG. 1. In a preferred embodiment of the present disclosure, the connector 1 is compatible to a USB Type-C standard and includes a tongue plate 11, a plurality of first connection terminals 13, a plurality of second connection terminals 14, two grounding boards 15 and a metal casing 16.

Figure 2:
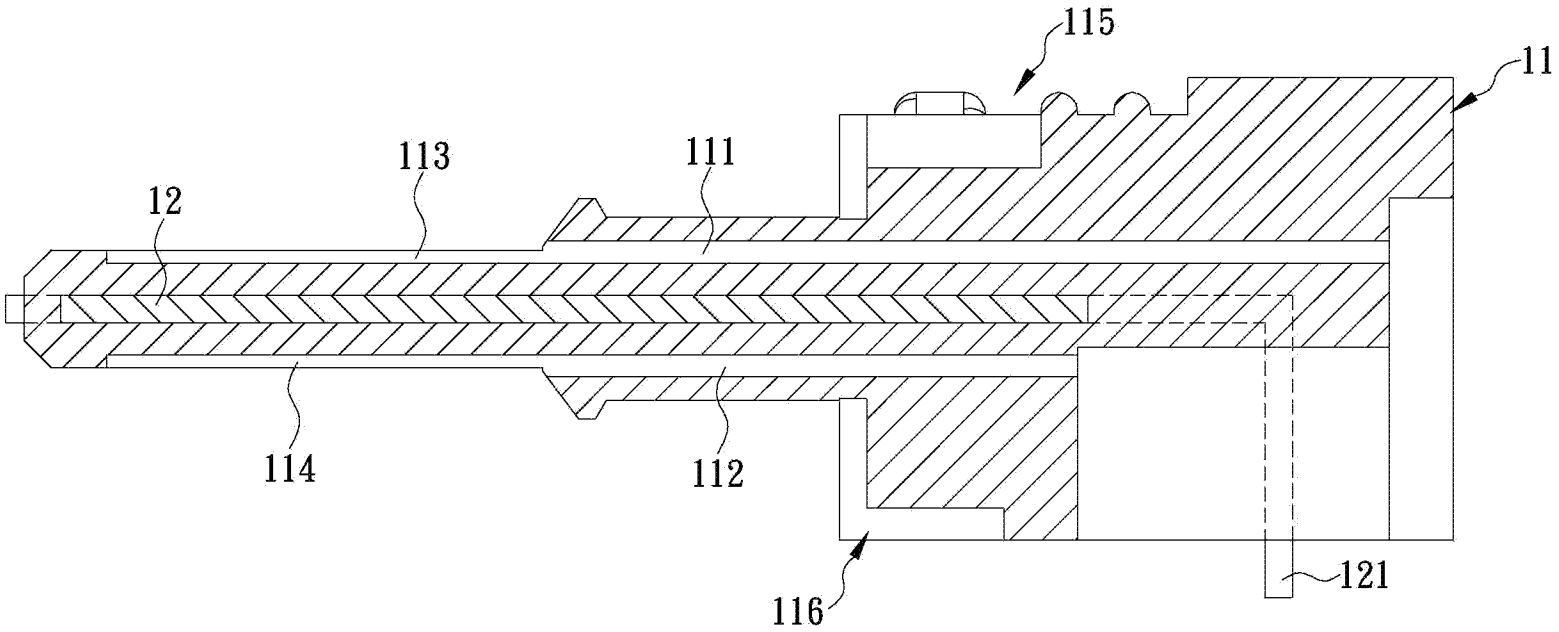
FIG. 2 is a section view of a tongue plate and a metal separating plate in the preferred embodiment of the present disclosure.

Please refer to FIG. 1 and FIG. 2. The tongue plate 11 is made of plastic integrally and provided with a metal separating plate 12 fixedly disposed therein. The tongue plate 11 is provided with a plurality of first insertion holes 111 and a plurality of second insertion holes 112 formed therein near a top surface and a bottom surface of the metal separating plate 12 respectively, and provided with a plurality of first connection slots 113 and a plurality of second connection slots 114 concavely formed at a top surface and a bottom surface thereof and near an end of the tongue plate 11. The first connection slots 113 are respectively communicated with ends of first insertion holes 111 corresponding thereto, and other ends of the first insertion holes 111 are exposed at the other end of the tongue plate 11. The second connection slots 114 are respectively communicated with ends of second insertion holes 112 corresponding thereto, and other ends of the second insertion holes 112 are exposed at the other end of the tongue plate 11. The tongue plate 11 is further provided with a first assembly slot 115 and a second assembly slot 116 concavely disposed at the top surface and the bottom surface thereof near other end thereof.

Please refer to FIG. 1 and FIG. 2. The first connection terminals 13 are inserted into the other end of the tongue plate 11 and respectively positioned inside the first insertion holes 111, so that portions of the first connection terminals 13 near the ends thereof can be exposed out of the top surface of the tongue plate 11 via the first connection slots 113. The second connection terminals 14 are inserted into the other end of the tongue plate 11 and respectively positioned inside the second insertion holes 112, so that portions of the second connection terminals 14 near the ends thereof can be exposed out of the bottom surface of the tongue plate 11 via the second connection slots 114. Structures of the grounding boards 15 respectively match with that of assembly slots 115 and 116, so the grounding boards 15 can be positioned in the assembly slots 115 and 116 and enclose an outer edge of the tongue plate 11 near other end of the tongue plate 11. The metal casing 16 has a structure matching with that of the tongue plate 11, so the tongue plate 11 and the grounding boards 15 can be assembled into the metal casing 16.

Figure 3:
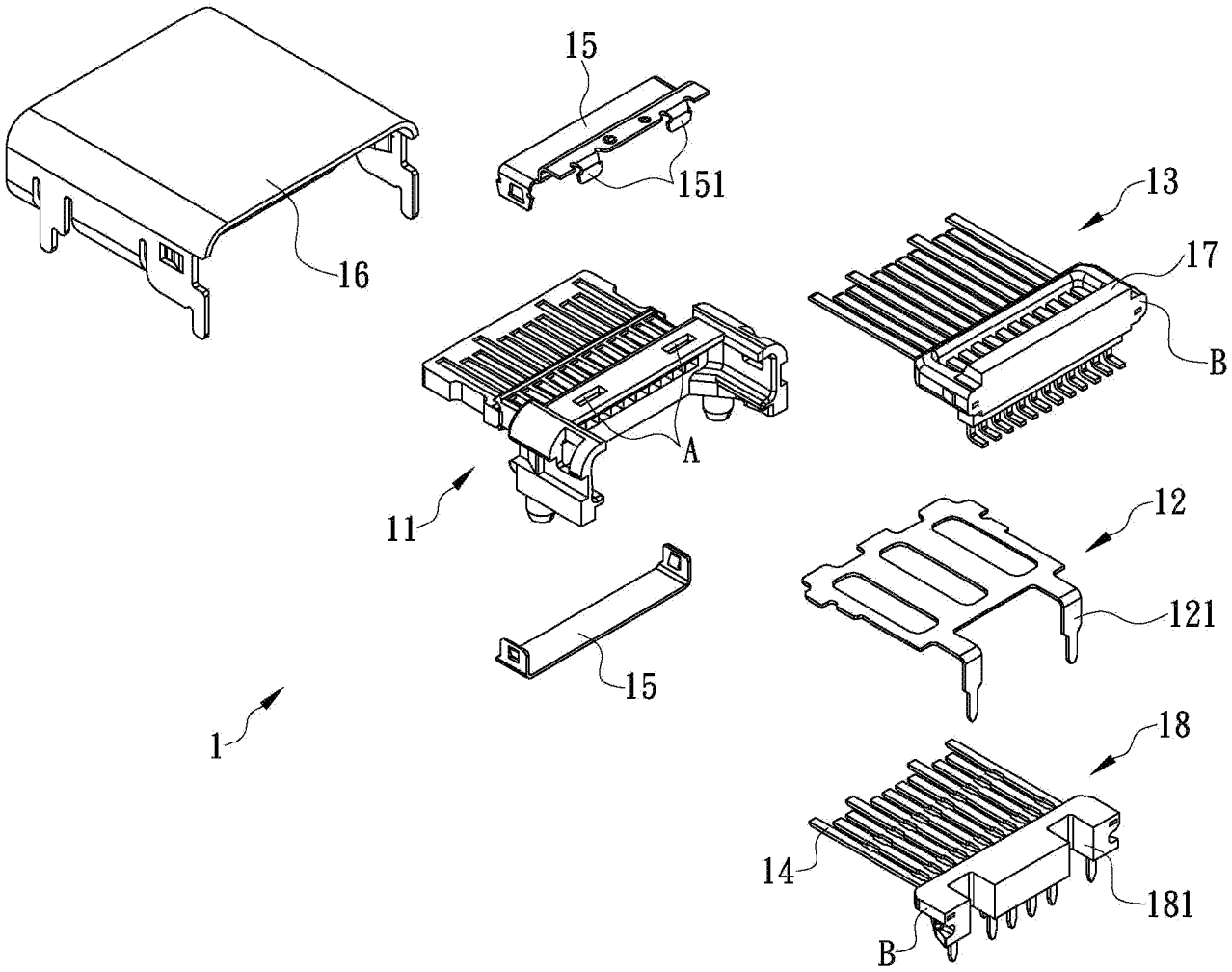
FIG. 3 is an exploded perspective view of a connector of other preferred embodiment of the present disclosure.
Figure 4:
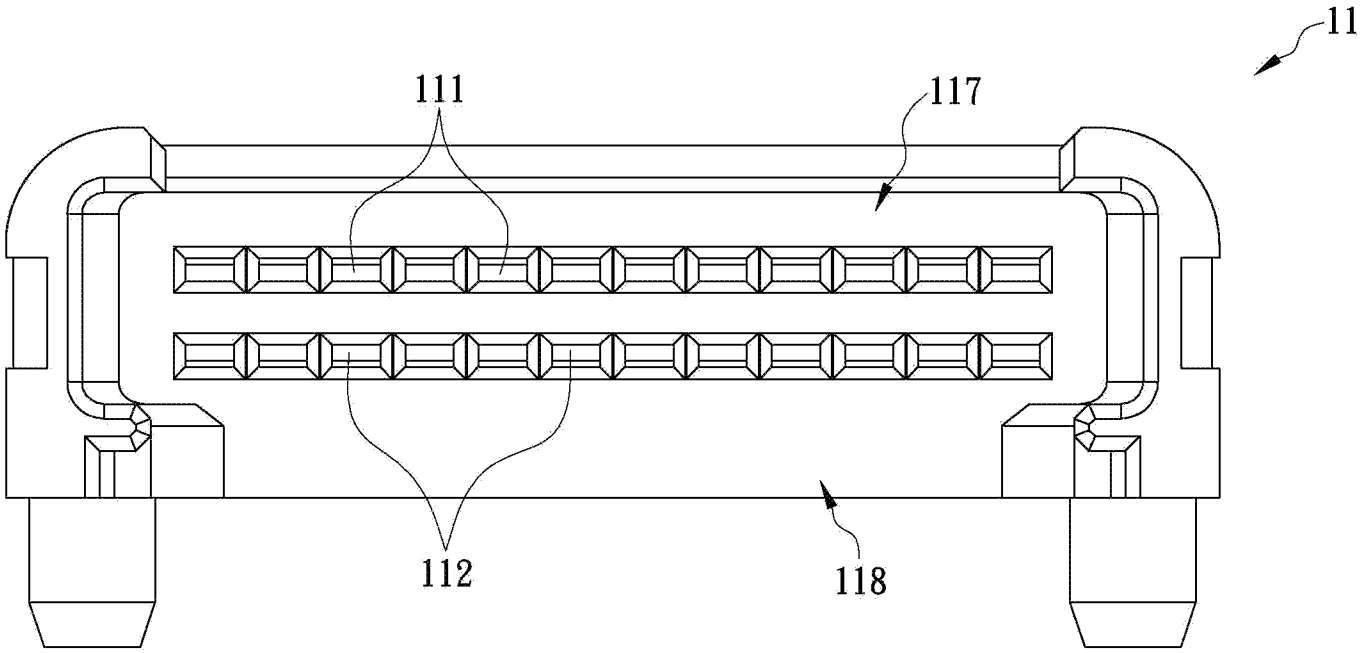
FIG. 4 is a plane schematic view of the other preferred embodiment of the present disclosure.

Please refer to FIG. 3 and FIG. 4. In other preferred embodiment of the present disclosure, the connector 1 further includes a first terminal block 17 and a second terminal block 18. The first terminal block 17 and the second terminal block 18 are made of plastic and made integrally on portions of the first connection terminals 13 and the second connection terminals 14 near other ends of the first connection terminals 13 and the second connection terminals 14, so that the manufacturer can conveniently insert the connection terminals 13 and 14 into the tongue plate 11. The tongue plate 11 is further provided with a first clamping slot 117 and a second clamping slot 118 concavely disposed at other end of the tongue plate 11 corresponding to the first insertion holes 111 and the second insertion holes 112. Structures of the clamping slots 117 and 118 respectively match with the terminal blocks 17 and 18, so that the terminal blocks 17 and 18 can be respectively accommodated and positioned in the clamping slots 117 and 118 when the connection terminals 13 and 14 are respectively inserted into the insertion holes 111 and 112 corresponding thereto. In this exemplary embodiment, each of the terminal blocks 17 and 18 is provided with guiding blocks B at two opposite side surfaces thereof, the guiding blocks B correspond to the clamping slot 117 and the second clamping slot 118, and structures of the guiding blocks B respectively match with the clamping slots 117 and 118, so that each of the terminal blocks 17 and 18 can be respectively assembled and positioned in the first clamping slot 117 and a second clamping slot 118, whereby the terminal blocks 17 and 18 can be combined with the tongue plate 11 integratedly.

Please refer to FIG. 3. The metal separating plate 12 is provided with at least one grounding part 121 downwardly extended from a rear end thereof. The second terminal block 18 is provided with a recessed portion 181 concavely disposed thereon corresponding to the grounding part 121. Therefore, when the second terminal block 18 is positioned in the second clamping slot 118, the grounding part 121 can be passed through the second terminal block 18 via the recessed portion 181, and then exposed out of the metal casing 16. However, in other embodiment of the present disclosure, as shown in FIG. 1 and FIG. 2, the grounding part 121 is downwardly extended from the rear end of the metal separating plate 12, and further located at two opposite side edges of the metal separating plate 12. When the connection terminals 13 and 14 are inserted into the insertion holes 111 and 112 corresponding thereto, the connection terminals 13 and 14 are located between the two opposite side edges of the metal separating plate 12, so the grounding part 121 can be prevented from interference with the connection terminals 13 and 14 and be exposed out of the metal casing 16. Please refer to FIG. 3. Each of the grounding boards 15 is provided with a fastening part 151 downwardly extended from the rear end thereof, and each of the assembly slots 115 and 116 is provided with a notch A concavely disposed at a position thereof corresponding to the fastening part 151. A structure of the fastening part 151 matches with that of the notch A, so the fastening parts 151 can be respectively assembled and positioned in the notches A, whereby the grounding boards 15 can be positioned and fastened in the assembly slots 115 and 116 respectively based on the combination of the fastening parts 151 and the notches A.

In traditional manufacturing method, the metal separating plate 12 and the connection terminals 13 and 14 are fastened together or inserted into the tongue plate 11 respectively, it causes the problems of too high manufacturing cost and low production yield rate. On the contrary, in the present disclosure the metal separating plate 12 is fixedly disposed in the tongue plate 11 by an integral formation, and the first and second connection terminals 13 and 14 are then inserted into an upper portion and lower portion of the tongue plate 11 relative to the metal separating plate 12, so that the problems caused in traditional manufacturing method can be prevented efficiently, and assembly difficulty can be efficiently reduced and production yield rate of the connector 1 can be improved efficiently, and the production efficiency can be further improved.

It particularly mentions that the connection terminals 13 and 14 are made by following steps. First, a conductive sheet is punched to form the connection terminals 13 and 14 with a plurality of bridges and a material channel. The bridges are located near ends of the connection terminals 13 and 14 and connected with the adjacent connection terminals 13 and 14. The material channel is connected with the other ends of the connection terminals 13 and 14, so that the manufacturer can conveniently insert the connection terminals 13 and 14 into the tongue plate 11 or integratedly form the terminal block on the connection terminals 13 and 14 near the other ends of the connection terminals 13 and 14. After the connection terminals 13 and 14 are positioned in the insertion holes 111 and 112, the bridges and the material channel are trimmed to remove by using jigs, so as to separate the connection terminals 13 and 14 from each other for further normal operations.

Figure 5:
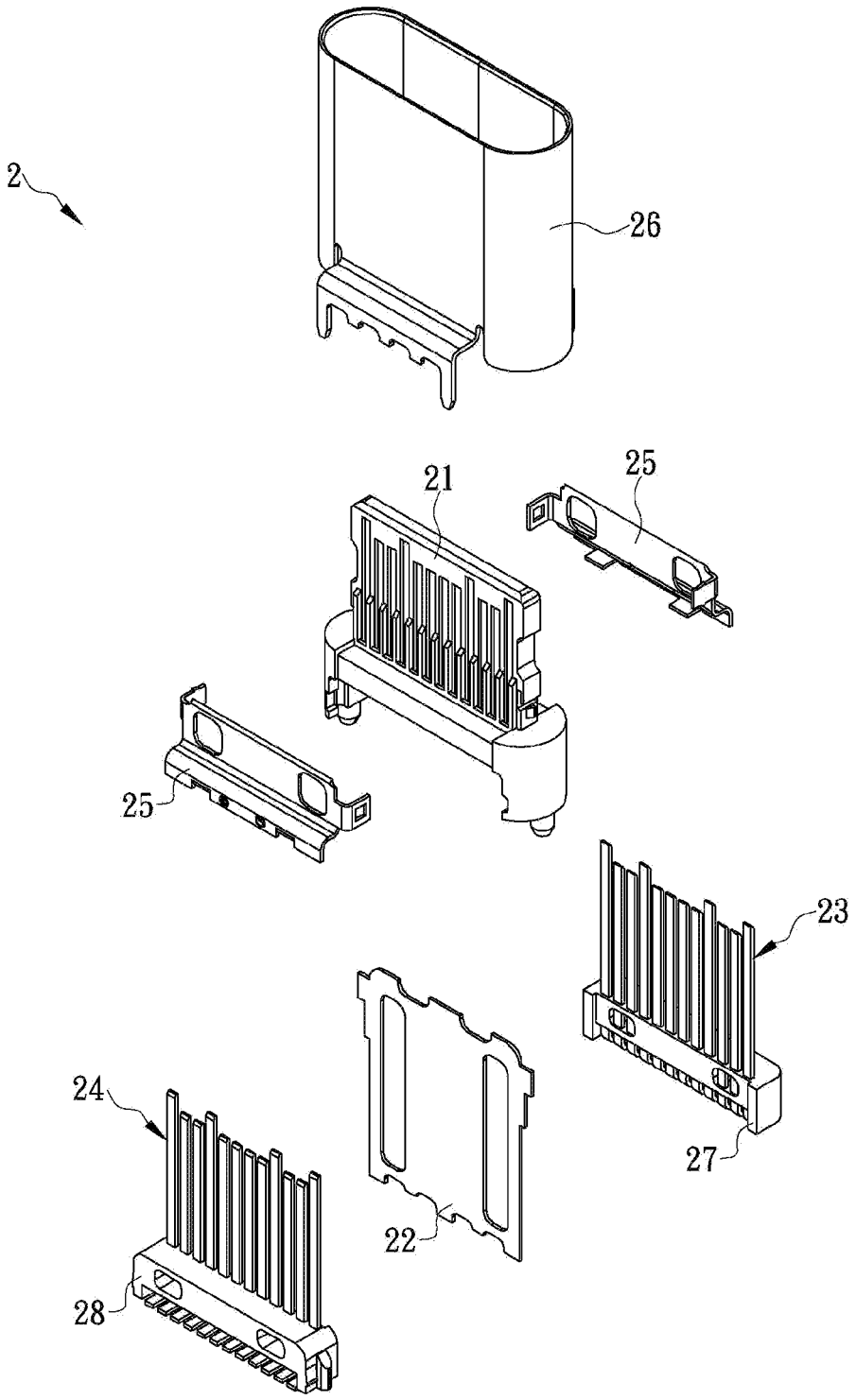
FIG. 5 is an exploded perspective view of a connector of another preferred embodiment of the present disclosure.

In the above-mentioned embodiment of the present disclosure shown in FIG. 1 and FIG. 3, the connector 1 is a horizontal type connector, i.e. the plug of the connector 1 is adjacent to the electrical connection position of a circuit board; however, the connector 1 can also be a vertical type connector, as another preferred embodiment shown in FIG. 5. The connector 2 includes a tongue plate 21, a plurality of first connection terminals 23, a plurality of second connection terminals 24, two grounding boards 25 and a metal casing 26. The tongue plate 21 is made of plastic integrally and provided with a metal separating plate 22 fixedly disposed therein. The first connection terminals 23 and the second connection terminals 24 are inserted into a side surface and other side surface of the tongue plate 21 near the metal separating plate 22, so portions of the first connection terminals 23 and the second connection terminals 24 near ends thereof can be exposed out of the side surface and other side surface of the tongue plate 21, and the terminal blocks 27 and 28 can be combined integratedly with the tongue plate 21. The grounding boards 25 can be positioned at outer edge of the tongue plate 21 to enclose the outer edge of the tongue plate 21. The tongue plate 21 and the grounding boards 25 can be assembled into the metal casing 26. Please refer back to FIG. 1 and FIG. 3. It should be noted that the connector 1 substantially has the same structure no mater being a horizontal type connector or a vertical type connector, so the structure of the connector 1 described in above-mentioned embodiment can be applied in the horizontal type connector or the vertical type connector.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A connector having a metal separating plate fastened by a tongue plate in integral formation, the connector comprising:

the tongue plate, made of plastic integrally and provided with the metal separating plate fixedly disposed therein, the tongue plate provided with a plurality of first insertion holes and a plurality of second insertion holes respectively formed therein near a top surface and a bottom surface of the metal separating plate, and provided with a plurality of first connection slots and a plurality of second connection slots concavely disposed on a top surface and a bottom surface thereof near an end thereof, and the plurality of first connection slots respectively communicated with ends of the plurality of first insertion holes corresponding thereto, other ends of the plurality of first insertion holes exposed out of other end of the tongue plate, the plurality of second connection slots respectively communicated with ends of the second insertion holes corresponding thereto, other ends of the plurality of second insertion holes exposed out of the other end of the tongue plate, and the tongue plate provided with a first assembly slot and a second assembly slot concavely disposed at the top surface and the bottom surface thereof near the other end thereof;

a plurality of first connection terminals, inserted into the other end of the tongue plate and respectively positioned inside the first insertion holes, to enable portions of the plurality of first connection terminals near the ends of the plurality of first connection terminals to be exposed out of the top surface of the tongue plate via the plurality of first connection slots;

a plurality of second connection terminals, inserted into the other end of the tongue plate and respectively positioned inside the second insertion holes, to enable portions of the second connection terminals near the ends of the second connection terminals to be exposed out of the bottom surface of the tongue plate via the plurality of second connection slots;

two grounding boards, having structures respectively matching with structures of the first assembly slot and the second assembly slot, whereby the two grounding boards can be positioned in the first assembly slot and the second assembly slot and enclose an outer edge of the tongue plate near other end of the tongue plate; and a metal casing, having a structure matching with a structure of the tongue plate, whereby the tongue plate and the two grounding boards can be assembled into the metal casing.

2. The connector as defined in claim 1, wherein the connector further comprises a first terminal block and a second terminal block, the first terminal block and the second terminal block are made of plastic and formed integrally at portions of the plurality of first connection terminals and the plurality of second connection terminals near other ends of the plurality of first connection terminals and the plurality of second connection terminals, the tongue plate is provided with a first clamping slot and a second clamping slot at the other end thereof corresponding to the plurality of first insertion holes and the plurality of second insertion holes, the first clamping slot and the second clamping slot have structures matching with structures of the first terminal block and the second terminal block to accommodate and position the first terminal block and the second terminal block.

3. The connector as defined in claim 2, wherein the metal separating plate is provided with at least one grounding part downwardly extended from a rear end thereof, and the second terminal block is provided with a recessed portion concavely disposed at a portion thereof corresponding to the at least one grounding part, and the grounding part is passed through the recessed portion.

4. The connector as defined in claim 1, wherein the metal separating plate is provided with at least one grounding part downwardly extended from a rear end thereof.

5. The connector as defined in claim 3, wherein the grounding part is located at two opposite side edges of the metal separating plate.

6. The connector as defined in claim 4, wherein the grounding part is located at two opposite side edges of the metal separating plate.

7. The connector as defined in claim 3, wherein each of the first terminal block and the second terminal block is respectively provided with guiding blocks at two opposite side surface thereof, and the guiding blocks respectively correspond to the first clamping slot and the second clamping slot, structures of the guiding blocks respectively match with structures of the plurality of clamping slots, so that each of the first terminal block and the second terminal block can be respectively assembled and positioned in the first clamping slot and the second clamping slot, to enable the first terminal block and the second terminal block to be combined with the tongue plate integratedly.

8. The connector as defined in claim 1, wherein each of the grounding boards is provided with a fastening part downwardly extended from the rear end thereof, and each of the first assembly slot and the second assembly slot is provided with a notch concavely disposed at a portion thereof corresponding to the fastening part, and a structure of each of the fastening parts matches with each of the notches, to enable each of the fastening parts to be respectively assembled and positioned into each of the notches.

9. The connector as defined in claim 2, wherein each of the grounding boards is provided with a fastening part downwardly extended from the rear end thereof, and each of the first assembly slot and the second assembly slot is provided with a notch concavely disposed at a portion thereof corresponding to the fastening part, and a structure of each of the fastening parts matches with each of the notches, to enable each of the fastening parts to be respectively assembled and positioned into each of the notches.

10. The connector as defined in claim 3, wherein each of the grounding boards is provided with a fastening part downwardly extended from the rear end thereof, and each of the first assembly slot and the second assembly slot is provided with a notch concavely disposed at a portion thereof corresponding to the fastening part, and a structure of each of the fastening parts matches with each of the notches, to enable each of the fastening parts to be respectively assembled and positioned into each of the notches.

11. The connector as defined in claim 4, wherein each of the grounding boards is provided with a fastening part downwardly extended from the rear end thereof, and each of the first assembly slot and the second assembly slot is provided with a notch concavely disposed at a portion thereof corresponding to the fastening part, and a structure of each of the fastening parts matches with each of the notches, to enable each of the fastening parts to be respectively assembled and positioned into each of the notches.

12. The connector as defined in claim 6, wherein each of the grounding boards is provided with a fastening part downwardly extended from the rear end thereof, and each of the first assembly slot and the second assembly slot is provided with a notch concavely disposed at a portion thereof corresponding to the fastening part, and a structure of each of the fastening parts matches with each of the notches, to enable each of the fastening parts to be respectively assembled and positioned into each of the notches.

* * * * *